United States Patent [19]

Coursaut

[11] 3,957,169

[45] May 18, 1976

[54] BOTTLE CAP

[75] Inventor: Henri Coursaut, Mercurey, France

[73] Assignee: Le Bouchage Mecanique, Paris, France

[22] Filed: Nov. 14, 1974

[21] Appl. No.: 523,760

[30] Foreign Application Priority Data

Nov. 16, 1973 France ..... 73.40820
Aug. 2, 1974 France ..... 74.26954

[52] U.S. Cl. ..... 215/253
[51] Int. Cl.[2] ..... B65D 41/32
[58] Field of Search ..... 215/230, 253, 256, 258, 215/252, 218

[56] References Cited

UNITED STATES PATENTS

| | | | |
|---|---|---|---|
| 1,875,431 | 9/1932 | Faluice | 215/256 |
| 3,335,889 | 8/1967 | Brumme | 215/253 |
| 3,904,062 | 9/1975 | Grussen | 215/258 |

FOREIGN PATENTS OR APPLICATIONS

| | | | |
|---|---|---|---|
| 1,268,937 | 6/1961 | France | 215/256 |
| 974,564 | 11/1964 | United Kingdom | 215/252 |
| 527,065 | 5/1955 | Italy | 215/253 |

*Primary Examiner*—Herbert F. Ross
*Attorney, Agent, or Firm*—Pennie & Edmonds

[57] ABSTRACT

A bottle cap comprises a sheet member having crown and skirt portions with a first plurality of perforations or indentations through the sheet member extending substantially around the skirt and a second plurality of perforations therethrough extending only part way around the skirt and defining, with perforations of the first plurality, at least one area on the member connected to the skirt both above and below the perforations of the first plurality by at least one bridge point between adjacent perforations.

7 Claims, 15 Drawing Figures

FIG. 13
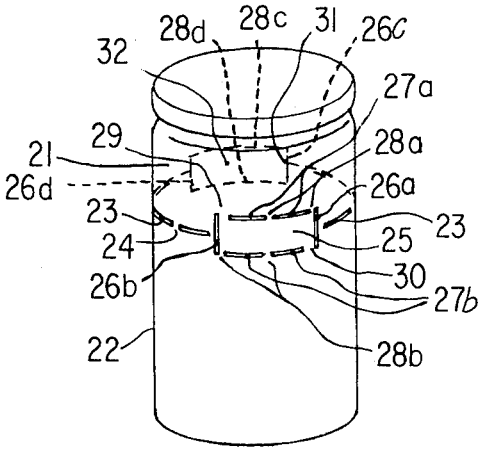
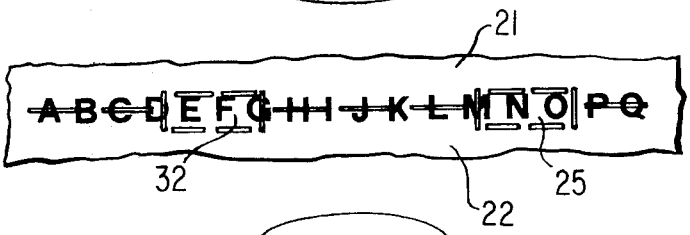
FIG. 15
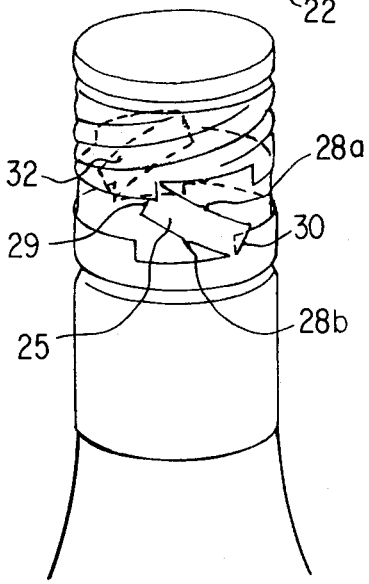
FIG. 14

BOTTLE CAP

The present invention pertains to screw-type caps for bottles or other containers. Caps of this type have been proposed comprising a crown and an attached skirt of generally cylindrical shape, with a circular line of perforations through the skirt dividing the skirt into upper and lower portions. When the bottle is capped after the initial filling, e.g. in bottling of the contents for sale, the upper portions of the skirt is rolled with flexible rollers or is otherwise pressed against the bottle neck, which has a male thread in its exterior surface, to form a mating female thread on the inside surface of the upper skirt portion. At the same time, the lower edge of the lower skirt portion is crimped beneath a ring-shaped protuberance on the exterior surface of the bottle neck, beneath the male thread above referred to.

With these known caps, when the bottle is first opened, the portion of the skirt beneath the ring of perforations remains crimped against the bottle. The threaded portion above that ring, rising with the helicoidal motion imposed on it by the unscrewing step, separates from the lower portion, all of the bridge points between adjacent perforations being ruptured in the process.

When such a bottle is reclosed, the upper and lower portions of the skirt tend to come back into substantial contact with each other, so much so that the fact of opening may be very little apparent.

It is often desired however, either by manufacturers of bottled goods or by public authorities, that the first opening become and remain permanently and unconcealably evident, by destruction or falling away of a portion of the skirt when the bottle is first opened.

It has already been proposed to provide a cap of the known type above described with a double circular line of perforations defining a tear strip which will be necessarily removed when the bottle is first opened. When the bottle is reclosed, there then remains a naked ring-shaped space on the bottle neck, showing that the bottle has been opened. This construction is however, subject to the disadvantage of requiring costly care in manufacture, and to the disadvantage that the caps are easily damaged in their initial application to the bottles by reason of the double row of incisions or perforations around the skirt thereof.

It is an object of the present invention to provide a cap free of these disadvantages and having other desirable properties. The cap of the invention is provided with a single circular line of weakening, produced by a single line of perforations or indentations, which divides the skirt into upper and lower portions. Furthermore, in accordance with the invention, a second plurality of indentations or perforations is formed in the cap, defining with the indentations or perforations of the first plurality an area on the skirt which is connected to each of the upper and lower skirt portions by at least one bridge point between adjacent indentations or perforations.

When a bottle capped with the cap of the invention is first opened, rotation of the upper portion of the cap necessarily ruptures to bridge point or points connecting this area of the skirt (hereinafter sometimes called a shield) to at least one of the upper and lower portions of the skirt.

According to a further feature of the invention, two or even more than two such "shields" are provided, desirably at diametrically opposite locations around the bottle neck, a second such shield being formed by the provision of a third plurality of perforations or indentations which, with perforations or indentations of the first plurality, define a second area on the skirt which is connected to each of the upper and lower skirt portions by at least one bridge point between adjacent perforations or indentations.

BRIEF DESCRIPTION OF THE DRAWINGS

The invention will now be further described in terms of a number presently preferred embodiments and by reference to the accompanying drawings in which:

FIGS. 13 and 14 illustrate a form of cap according to the invention including two removable tear shields; and FIG. 15 is a developed view of the tear shields and of the junction between the upper and lower skirt portions in the cap of FIG. 13.

DESCRIPTION OF PREFERRED EMBODIMENTS

Figure 1:
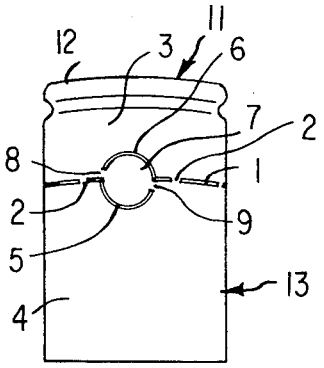
FIG. 1 is a view substantially in side elevation of one form of cap according to the invention, before its application to a bottle.

Referring to FIG. 1, the cap of the invention comprises a sheet metal member generally indicated at 11, drawn or otherwise formed into an essentially cup-shape, with a crown 12 and a skirt generally indicated at 13. The skirt is divided into upper and lower portions 3 and 4 by a circular row of perforations or indentations (hereinafter collectively called perforations) 1. Adjacent perforations 1 are separated by bridge points 2. A supplementary perforation or incision, or a second plurality thereof such as those of arcuate shape shown at 5 and 6, define on the skirt a shield 7 connected to the upper portion of the skirt by a bridge point 8 and to the lower portion of the skirt by a bridge point 9.

Figure 2:
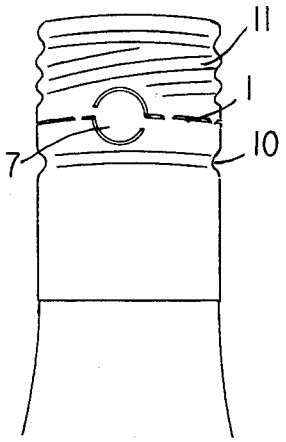
FIG. 2 is a similar view of the cap of FIG. 1 but after affixation to a bottle.

FIG. 2 shows the cap of FIG. 1 as applied to the neck of a bottle having a male thread thereon. In FIG. 2 the cap will be seen to have been crimped, in the lower skirt portion thereof, into an annular groove 10 below the thread and also below the perforations 1, 5 and 6, and to have been crimped or otherwise rolled or forced, above all of those perforations, into a male thread on the bottle so as to form a thread 11 in the cap itself.

Figure 3:
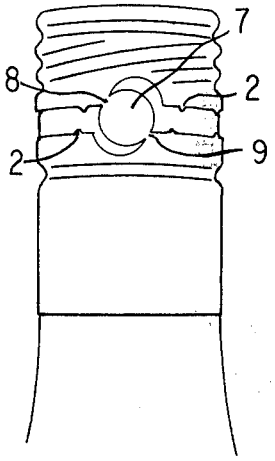
FIG. 3 is a view similar to that of FIG. 2 but showing the caps in process of rupture in the course of initial opening of the bottle.
Figure 3:
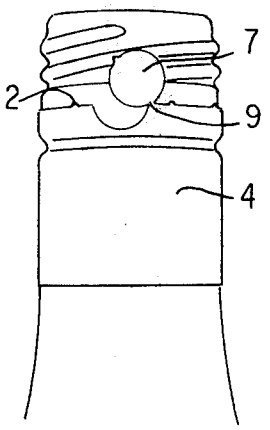
Figure 5:
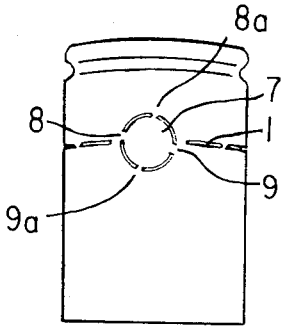
FIGS. 5 to 8 are views respectively similar to those of FIGS. 1 to 4 but illustrating a modified cap construction according to the invention.
Figure 6:
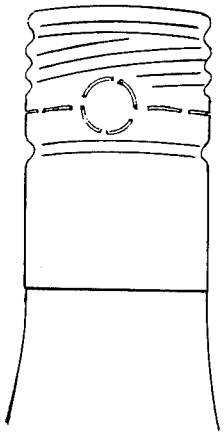
Figure 8:
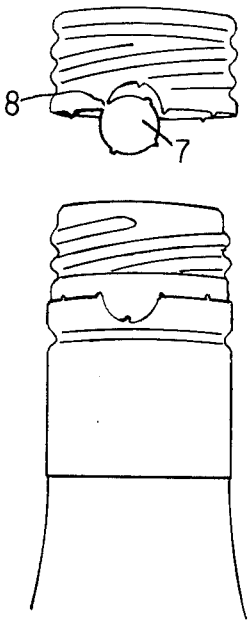

FIG. 3 shows how in a first opening of the bottle of FIG. 2 the bridge points 2 are ruptured and how in the process the shield 7 pivots about its coupling or bridge points at 8 and 9 under a couple of forces produced at those points upon unscrewing of the bottle cap.

Figure 4:
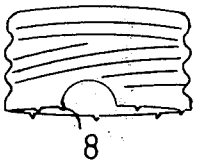
FIG. 4 shows the bottle of FIG. 2 completely opened.

FIG. 4 shows the conditions of the cap after opening of the bottle. The bridge point 8 has broken and the shield 7 hangs, in displaced fashion, to the lower portion of the skirt only at the much weakened bridge point 9.

If the detachable shield is small it will suffice to connect it to the cap with as few as two bridge points. It may however be desired to provide additional bridge points, as indicated at 8*a* and 9*a* in FIGS. 5 to 8.

Preferably the construction is such that the bridge points 8 and 9 are wider than the supplementary bridge points 8*a* and 9*a* so as to insure that both of the latter are ruptured upon opening of the bottle before either of the former. In this way it will be assured that an opening of the bottle the shield 7 will be bodily displaced, even if only by rotation, from its original position with respect to each of the upper and lower skirt portions. Thus, on reclosing of the bottle, there is little danger that the shield will resume its former positions vis-a-vis both skirt portions, with consequent risk that the opened nature of the bottle will pass unnoticed.

Figure 9:
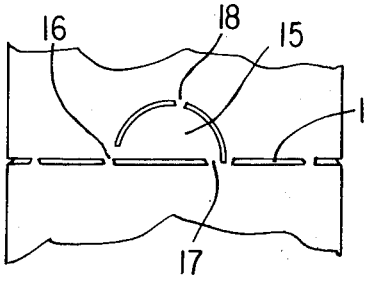
FIGS. 9 and 10 illustrate schematically a third form of cap according to the invention.

In the embodiments of the invention heretofore described the shield straddles the principal line of weakening in the cap defined by the perforations 1. In the embodiment of FIG. 9 in contrast the detachable shield 15 lies entirely above the line of perforations 1 and is connected to the upper portions of the cap skirt by a bridge point 16 and to the lower portion by a bridge point 17. An auxiliary bridge point 18 is provided to reduce the fragility of the shield and to make it better adapted to withstand the stresses encountered in the capping process.

Figure 10:
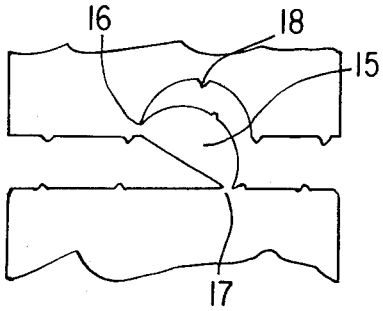

FIG. 10 shows the progressive deformation of the shield of FIG. 9 in the course of initial opening of the bottle. In the state of affairs illustrated in FIG. 10, the bridge point 18 has ruptured but the bridge points 16 and 17, though in process of tearing, still exist.

Figure 11:
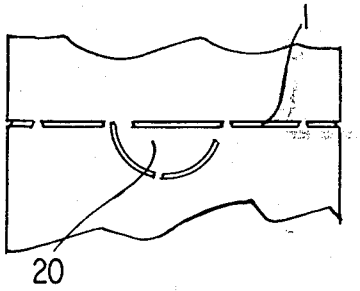
FIGS. 11 and 12 illustrate schematically still another form of cap according to the invention.
Figure 12:
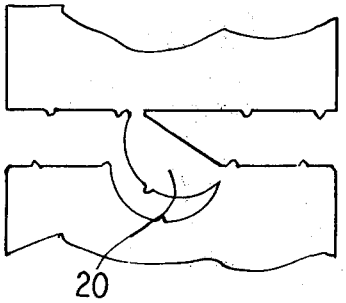

FIGS. 11 and 12 show an embodiment similar to that of FIGS. 9 and 10 with the difference that the shield 20 of semicircular shape is disposed below the principal line of weakening formed by perforations 1 rather than above it. The embodiment of FIGS. 11 and 12 is particularly advantageous for caps intended to close short-necked bottles, since the shield 20 is less exposed to the risk of damage from the rollers which form the threads in the cap at the time when the bottle is initially capped.

In the caps hereinabove described, the detachable shields are circular or semicircular in shape but the invention is not limited thereto and includes shields of oval, square, rectangular or other shapes.

In FIG. 13 there is seen a cap having two shields 25 and 32, 180° apart around the circumference of the bottle neck. The first plurality of perforations which separate the skirt into upper and lower portions 21 and 22 may be regarded as comprising the two arcuate, co-planar rows of perforations 23 and the additional perforations making up one half of the perforations defining each of the shields 25 and 32. The remaining perforations defining one of these shields thus constitute a second plurality of perforations which with those of the first plurality define one shield. The remaining perforations defining the other shield thus constitute a third plurality of perforations which with those of the first plurality define the other shield.

Referring particularly to FIG. 13, the first plurality may be taken to include the perforations 23 both to the left and right of shield 25, one half of each of the vertical perforations 26*a* through *d*, the upper front perforations 27*a*, and the upper rear perforations 28*c*. The second plurality may thus comprise one half of each of 26*a* and 26*b*, and the lower front perforations 28*b*. The third plurality of perforations may thus comprise one half of each of the rear vertical perforations 26*c* and 26*d*, and the lower rear perforations 28*d*.

Figure 7:
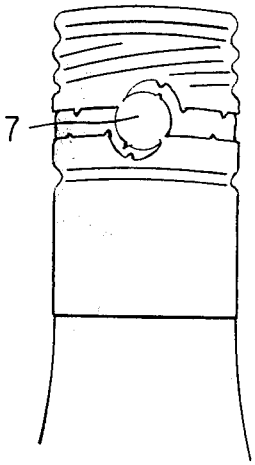

FIG. 14 shows that, as in FIG. 7, the bridge points 24, 28*a* and 28*b* of the shield 25 have ruptured whereas the bridge points 29 and 30 are as yet only on the point of doing so. The shield 32 is seen to be in a similar condition.

In FIG. 15, which is a fragmentary developed view of the skirt at the height of the circular line of weakening produced by the perforations of the first plurality above defined with respect to FIG. 13, there are seen the detachable rectangular shields 25 and 32. An advertising or other messaage may be imprinted on the cap over this line of weakening, with two detachable shields a greater portion of this legend will be destroyed upon opening of the bottle.

There may be made various modifications in and departures from the embodiments hereinabove described without departing from the invention. Thus, in the case of the skirt having two detachable shield portions therein it is obviously desirable to dispose these in diametrically opposite positions, as this makes it possible to observe the presence or absence of a shield and hence the opened or unopened condition of the bottle without rotating it about its own axis. When however the cap includes more than two detachable shields they may be distributed in any desired fashion around the cap.

Apart from the principal advantage hereinabove set forth, the cap of the invention has the following favorable properties: If desired, it is possible to print on the cap an inscription or design which will disappear at least in part when the bottle is opened. In particular when used for alcohol beverages the detachable shield may bear a tax stamp which will then be unavoidably and irremediably destroyed on the first opening of the bottle.

In view of the small number of perforations in the skirt thereof the cap of the invention remains strong, practically equal to that of caps not having more than a single horizontal line of perforations.

While the invention has been described hereinabove in terms of a number of presently preferred embodiments thereof, the invention itself is not limited thereto but rather comprehends all modifications of and departures from those embodiments properly falling within the spirit and scope of the appended claims.

I claim:

1. A bottle cap comprising a sheet member having a crown and a skirt, said member having formed therein a first plurality of perforations defining a first line of weakening which extends substantially around said skirt and divides said skirt into upper and lower portions, said member further having formed therein a second plurality of perforations defining a second line of weakening which extends only part-way around said skirt, which begins and ends at spaced apart locations on said first-named line, and which defines with a part of said first-named line between said locations an area on said skirt connected to each of said upper and lower portions by at least one bridge point between adjacent perforations.

2. A bottle cap according to claim 1 wherein the points of said first plurality are disposed substantially in a circle and wherein the points of said second plurality are disposed on the side of said circle away from said crown portion.

3. A bottle cap according to claim 1 wherein the points of said first plurality define a circle about said skirt and wherein said area is substantially bisected by said circle.

4. A bottle cap comprising a sheet member having a crown and a skirt, said member having formed therein a first plurality of perforations defining a first line of weakening which extends substantially around said skirt and divides said skirt into upper and lower portions, and a second plurality of perforations which extends only part-way around said skirt and which defines with a part of said first line an area on said skirt connected to each of said upper and lower portions by at least one bridge point between adjacent perforations, said member further having formed therein at least one additional plurality of perforations which extends only part-way around said skirt, the perforations of each said additional plurality defining with a part of said first line an additional area on said skirt connected to each of said portions by at least one bridge point between adjacent perforations.

5. A bottle cap according to claim 4 wherein said areas are substantially uniformly spaced about said skirt.

6. A bottle cap according to claim 4, wherein said area bears an indicium.

7. A bottle cap comprising a sheet member having a crown and a skirt, said member having formed therein a first plurality of perforations defining a first line of weakening which extends substantially around said skirt and divides said skirt into upper and lower portions, said member further having formed therein a second plurality of perforations defining a second line of weakening which extends only part-way around said skirt, which begins and ends at two spaced apart locations on said first-named line, and which defines with a part of said first-named line between said locations an area on said skirt, said area being connected to said upper portion at one of said locations by a first bridge point and to said lower portion at said other of said two locations by a second bridge point, said first and second bridge points being wider than other bridge points connecting said area to said upper and lower portions.

* * * * *